US006029865A

United States Patent [19]

Dupes et al.

[11] Patent Number: 6,029,865

[45] Date of Patent: Feb. 29, 2000

[54] SEALED CARTON HAVING A SEPARATE INNER POUR-SPOUT

[75] Inventors: David B. Dupes, York, S.C.; James H. Sewell, Concord, N.C.

[73] Assignee: Roberts PolyPro, Inc., Charlotte, N.C.

[21] Appl. No.: 09/120,820

[22] Filed: Jul. 22, 1998

[51] Int. Cl.[7] ..... B67D 5/06

[52] U.S. Cl. ..... 222/531; 229/125.04

[58] Field of Search ..... 222/531, 533, 222/535; 229/125.04, 125.15

[56] References Cited

U.S. PATENT DOCUMENTS

| | | | |
|---|---|---|---|
| 443,154 | 12/1890 | Wagandt . | |
| 3,057,625 | 10/1962 | Malachick . | |
| 3,438,555 | 4/1969 | Pierre . | |
| 3,484,034 | 12/1969 | Sternau | 229/125.04 |
| 3,565,300 | 2/1971 | Dietz et al. . | |
| 3,843,029 | 10/1974 | Bezzecchi . | |
| 3,989,171 | 11/1976 | Arneson . | |
| 4,150,778 | 4/1979 | Engdahl, Jr. . | |
| 4,194,677 | 3/1980 | Wysocki . | |
| 4,475,683 | 10/1984 | Vogt . | |
| 4,760,938 | 8/1988 | Wenger . | |
| 5,014,888 | 5/1991 | Bryan . | |
| 5,078,872 | 1/1992 | Durant et al. . | |
| 5,215,250 | 6/1993 | Roccaforte . | |
| 5,238,181 | 8/1993 | Mahler . | |
| 5,372,301 | 12/1994 | Besson | 229/125.04 |
| 5,445,316 | 8/1995 | Roccaforte . | |
| 5,531,376 | 7/1996 | Brink et al. . | |
| 5,678,755 | 10/1997 | Block . | |

*Primary Examiner*—P. Derakshani
*Attorney, Agent, or Firm*—Nexsen Pruet Jacobs & Pollard, LLP

[57] ABSTRACT

A novel container having an internal pour spout is provided, the sealed container carrying a pour spout having a central platform, a first side panel connected by hinge to the platform on a first side and a second panel connected by hinge to the platform on a second side, the two side panels having a substantially triangular shape. The hinged connection of the panels to the platform permit each pour spout to be provided in a flattened configuration in which the side panels permit subsequent processing of the flattened carton stock. When the carton is folded, the panels move passively in response to the carton folding steps and assume an assembled configuration as the carton is assembled.

16 Claims, 4 Drawing Sheets

SEALED CARTON HAVING A SEPARATE INNER POUR-SPOUT

BACKGROUND OF THE INVENTION

1. Field of the Invention

This invention is directed towards a paper board carton having an inner reclosable pour spout. In particular, it relates to a dispensing container of the type used in the packing of granular, crystal, and powder products, as well as dry food items such as cereals and pasta products.

2. Description of the Background Art

Pour spouts of cartons have typically included perforated openings in which the carton walls provide a reclosable spout. As used herein, "pour spout" means a separate pour spout provided from materials, such as plastic, metal, or paperboard, and which are distinct from the carton itself.

External plastic pour spouts are known in the art as cited in U.S. Pat. No. 5,667,111, incorporated herein by reference. However, there exists room for improvement within the art of cartons and similar containers having pour spouts.

OBJECTS OF THE INVENTION

It is an object of this invention to provide a separate pour-spout for use with a cardboard container.

It is to a further and more particular object of this invention to provide a pour-spout which can be installed on a interior carton wall of a carton blank prior to the folding and filling of the carton.

It is to a further and more particular object of this invention to provide a novel container having an internal pour-spout having an initially sealed and sift-proof configuration.

These and other objects of the invention are provided by a container comprising:

a platform; a first side panel hingedly connected to a first side of the platform, the first side panel further having an upper arcuate edge, the arcuate edge further defining a projection along a terminus of the arcuate edge; a second side panel hingedly connected to a second side of the platform, the second side panel further having an upper arcuate edge, the arcuate edge further defining a projection along a terminus of the arcuate edge; a carton flap defined by a partial scoring along a carton panel surface, an interior surface of said flap secured to a surface of the platform; whereby, when the carton is sealed, the pour-spout is carried on the interior of said carton by the flap interior wall, the carton flap, upon being engaged by a consumer, is pulled outwardly providing communication with an interior of the carton.

The pour spout defines a first platform hinge connection and a second platform hinge connection each connection further providing a connection with a weak memory. This allows the pour spout to assume a dispensing shape upon the engagement of the flap, whereby the carton edge walls which define the flap maintain the side panels of the pour spout in an operative position.

A process of assembling a container having a pour spout is also disclosed comprising the following steps:

providing an unfolded article of carton stock having at least one flat surface; providing a pour spout comprising a central platform hingedly connected to a first side panel and a second side panel, the pour-spout having an initial flattened configuration; securing the central platform to the flat surface, the platform positioned within a partially weakened scored, perforated or cut flap region defined by the carton stock; folding the carton stock article into an assembled container; whereby, a sealed container is provided having a pour spout which deploys into a pouring configuration upon the engagement of the flap region.

DETAILED DESCRIPTION OF THE INVENTION

Figure 1:
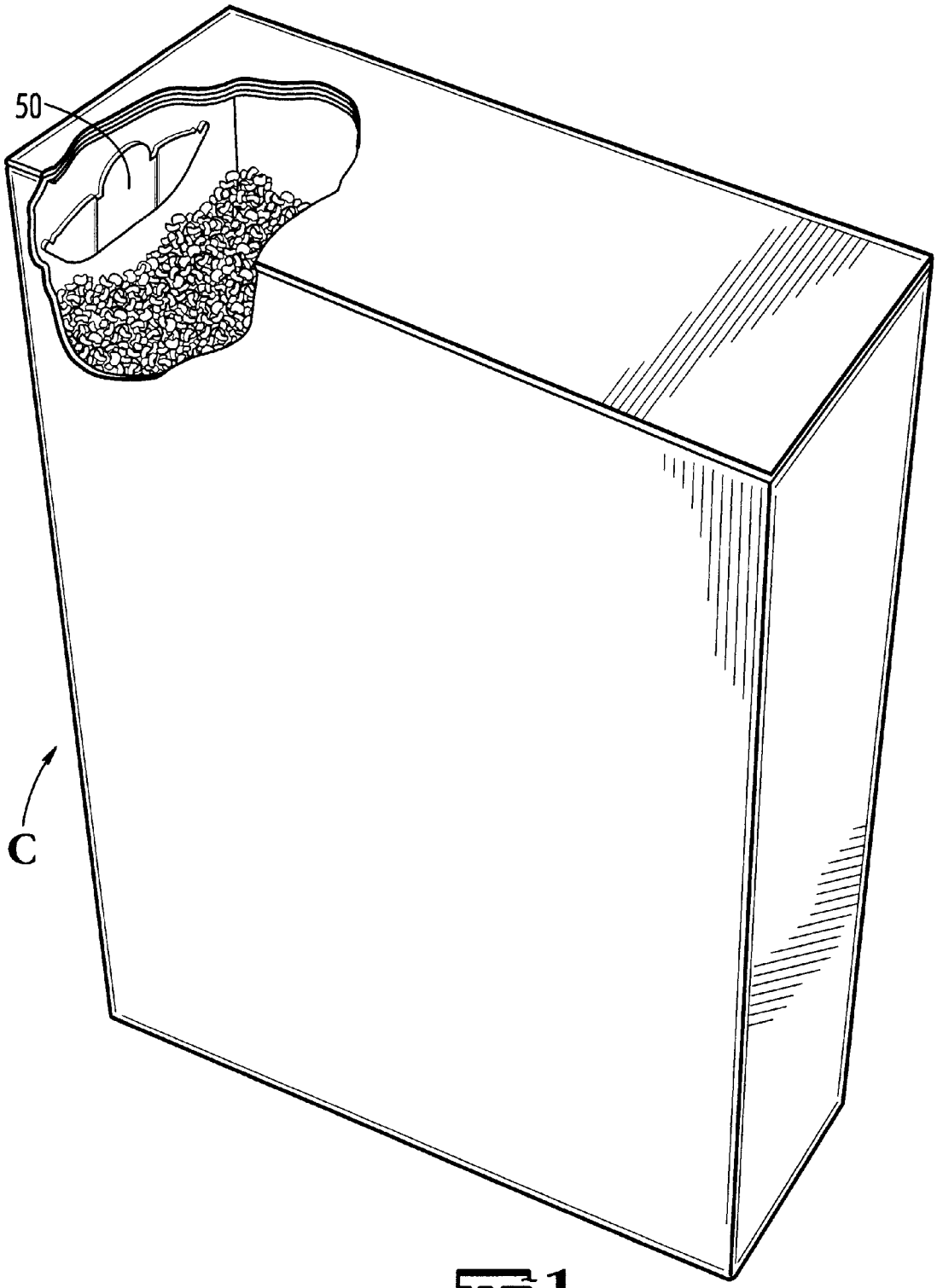
FIG. 1 is a perspective view of a dispensing carton having a pour spout embodying features of the present invention.
Figure 5:
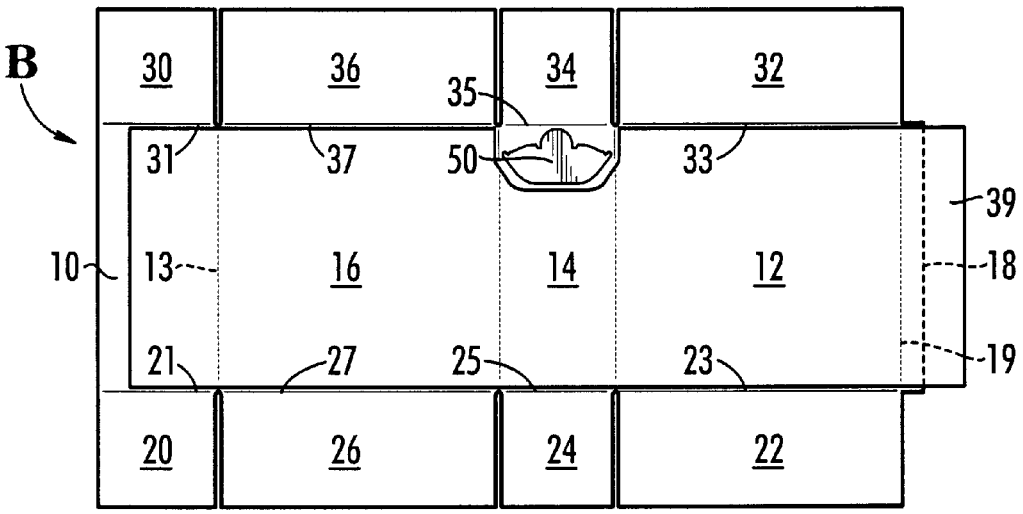
FIG. 5 is a plan view of a foldable sheet material from which a preferred embodiment of a dispensing carton may be formed.

In reference to the figures, a carton C as indicated in FIG. 1 may be formed from a unitary blank B of foldable sheet material such as paper board illustrated in FIG. 5. The body portion of the carton includes a first minor sidewall panel 10, a first major sidewall panel 12, a second minor sidewall panel 14, a second major sidewall panel 16, and a glue panel 18, which are foldably joined to each other along parallel fold lines 13, 15, 17, and 19, all of which extend transversely of blank B.

When the glue panel 18 is secured, as by an adhesive, to first minor sidewall panel 10 to form a manufacturer's joint in a conventional manner, a tubular body structure is formed which is open at the upper and lower end.

The lower end of the carton has a bottom closure arrangement that includes a pair of minor bottom closure flaps 20 and 24, foldably joined to lower edges of minor sidewall panels 10 and 14 along fold lines 21 and 25 respectively, and a pair of major bottom closure flaps 22 and 26, foldably joined to lower edges of major side panels 12 and 16 along fold lines 23 and 27, respectively. The bottom closure flaps may be folded into overlapping relation and secured to each other by an adhesive as is well-known within the art.

The upper end of the carton has a similar closure flap arrangement that includes a minor closure flap 30 and 34, foldably joined to the upper edges of minor sidewall panels 10 and 14 along fold lines 31 and 35, respectively. The carton also has major closing flaps 32 and 36 foldably joined to the upper edges of the major sidewall panels 12 and 16 along fold lines 33 and 37, respectively. The top closure flaps may be secured to each other in overlapping relation in a conventional manner as is well known in the art. As seen in FIG. 5, an optional liner 39 may be provided.

Prior to folding the unitary blank B, a separate pour-spout 50 is installed along interior side of panel 14. As best seen in reference to FIGS. 1 & 4, a pour spout 50 is positioned along the interior surface of the carton and opposite panel flap 40. Spout 50 has a central panel 51 glued to panel flap 40. A pair of side panels 52 and 54 are each connected to central panel 51 by a score line 55. The score lines provide a weak memory to the pour-spout and facilitate the passive folding of the side panel relative to the central panel during carton erection as well as during the operation of the pour-spout. An optional upper tab 56 is connected to the upper side of panel 51 by a score line 57. Where present, tab 56 is not secured directly to the carton, but rather provides a flexible member of the spout which can be easily grasped and used to open the pour spout.

A spaced gap 58 and 59 is defined between each respective side panel 52 and 54 and a corresponding edge of tab 56. Each side panel further defines a terminal projection 61 at an upper corner of each panel. An upper arcuate panel edge 63 is in communication with respected projection 61. Each edge 63 further defines a raised shoulder 65 and a notch 67, notch 67 positioned between the respective shoulder 65 and projection 61.

Figure 4:
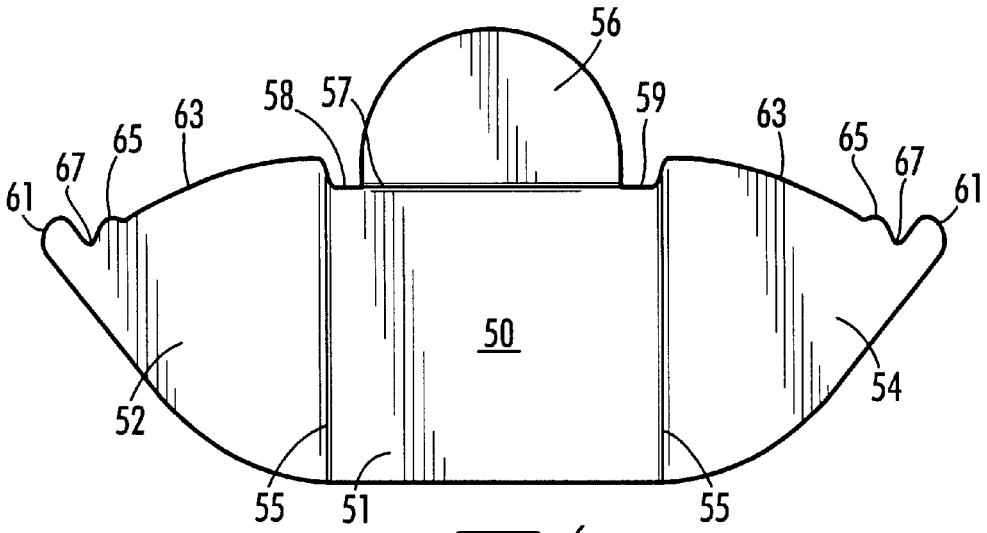
FIG. 4 is a front plan view of an embodiment of the pour spout as seen in an unfolded configuration.
Figure 6:
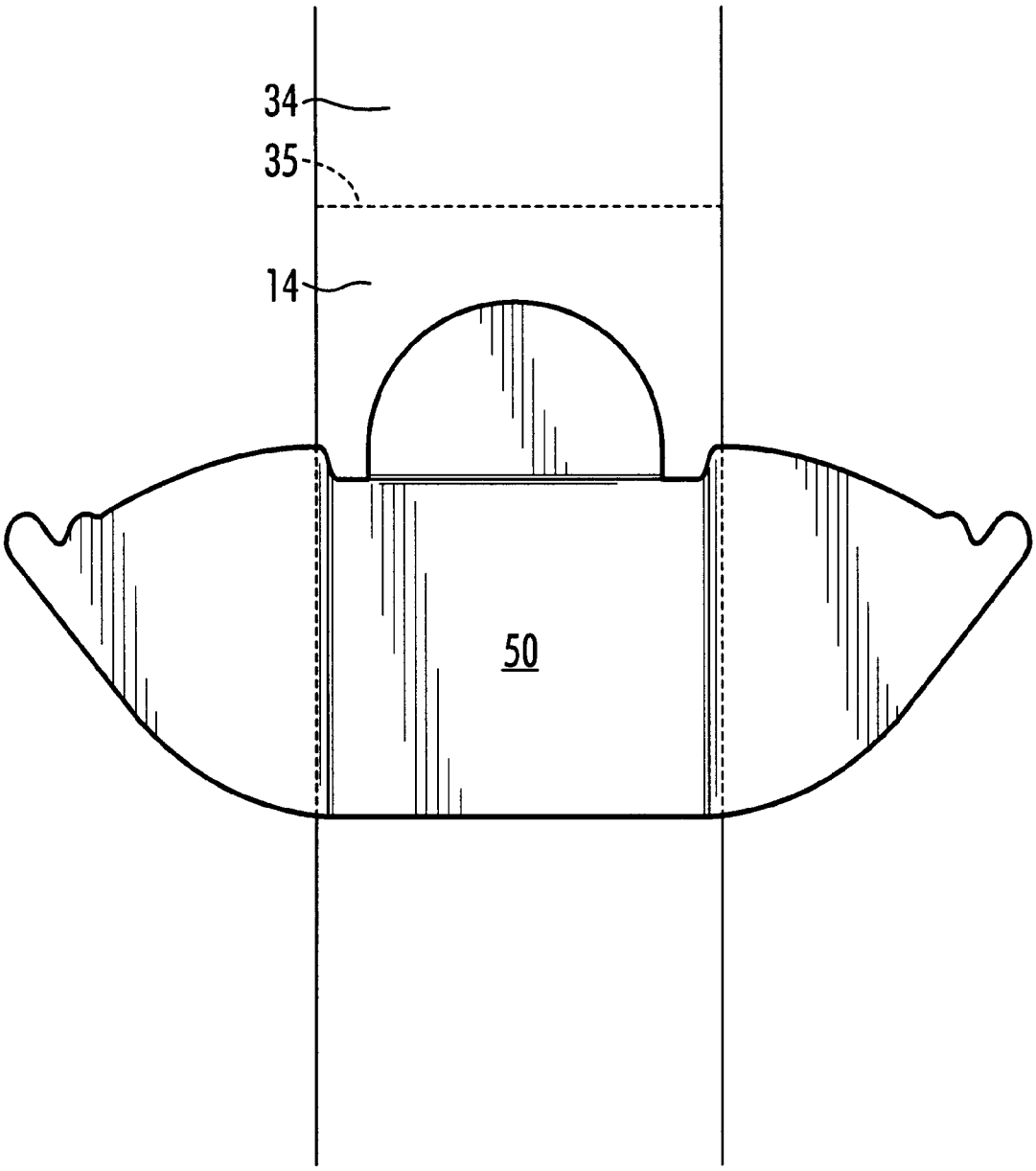
FIG. 6 is a plan view of a pour spout installed onto a panel, the pour-spout having a central panel width slightly less than the carton panel width.

Pour-spout 50 can be provided from a thin sheet of plastic, from paperboard stock, or from other thin and flexible materials such as acetate film or other similar, flexible, materials. As seen in FIGS. 5 and 6, the placement of the pour-spout in an initial flat configuration allows the pour-spout to be installed prior to the direction filling of the assembled cartons. As seen in FIG. 4, if a pour-spout fits entirely within a panel, the flap configuration of the pour-spout does not interfere with the traditional blank dispensing, folding, and filling steps. As seen in FIG. 6, if the central panel of the pour-spout is approximately the same width as the associated carton panel, the flexible hinge portions facilitate the passive folding of the pour-spout side panels to a position adjacent the major sidewalls as the carton is erected.

Figure 2:
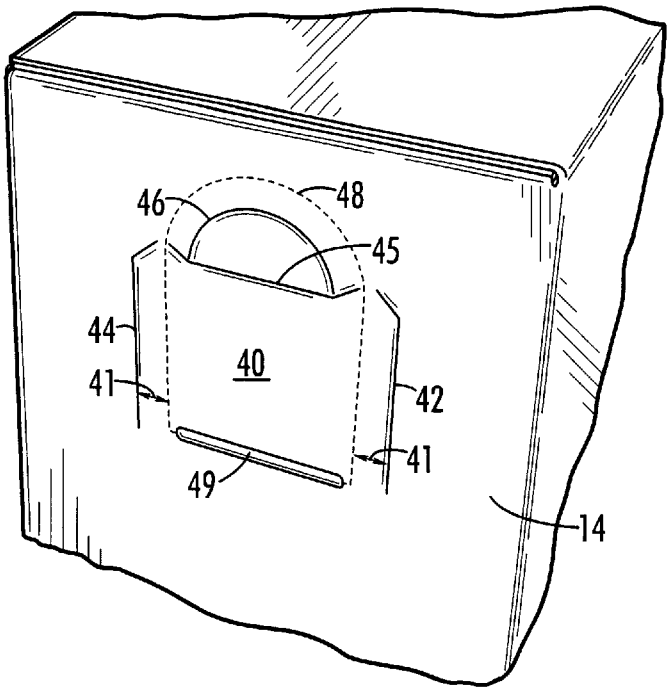
FIG. 2 is a perspective side view of an exterior of a carton wall as adapted for use with an internal pour spout.

To accommodate the operation of the pour-spout, and as seen in reference to FIG. 2, the exterior side of panel 14 is partially scored to define a reclosable panel flap 40. Panel flap 40 is defined by plurality of substantially vertical partial cuts 42 and 44, a horizontal cut 45, and an arcuate cut 46, all of which are cut from the exterior carton side. An additional partial cut is provided on the inner surface of the carton as seen in FIG. 2 by dashed or cut line 48. An embossed region 49 defines a lower hinge region of the panel flap 40.

When panel 40 is withdrawn, the pour-spout side panels 52 and 54 form substantially right angles with respect to central panel 51. The side panels are retained in position by the interaction of the cut carton walls to the panels. The arcuate panel edges 63 provide a smooth opening motion. Projections 61 provide a mechanical stop for the open spout. Optional notch 67 provides a locking mechanism to keep the spout open during pouring of the carton contents. If desired, a channel cut into the carton opposite the arcuate edges 63 could be provided to improve the movement of the pour-spout 50.

However, a variety of different carton opening mechanisms may be employed to initiate access to the pour spout 50. As seen in the preferred embodiment, a weakened carton area is defined by partial cuts which surround the pour spout area. However, other access features are possible such as tear strips, perforations, score lines, other carton opening mechanisms known in the art, and combinations thereof.

After the pour-spout 50 has been installed, and the carton folded, filled, and closed in a conventional manner, the resulting sealed carton has a "sift-proof" design. That is to say that fine granular powders and like materials will not migrate along the pour-spout area as occurs in some externally applied or positioned pour-spout cartons.

As seen in the preferred embodiment, the pour-spout 50 can be installed flat against a portion of the inner carton. If the pour spout 50 fits (unfolded) within a panel as illustrated in FIG. 5, the carton is erected and filled in the normal fashion. For certain products, a relatively larger sized pour-spout 50 may be needed to provide for a smooth product flow through the pour-spout 50. In such circumstances, a portion of the side panels 52 and 54 may extend beyond a respective fold line of the carton wall. If so, the score line 55 permits the side panels 52, 54 to fold as needed as the carton is erected and filled.

As seen in FIG. 6, if the pour-spout 50 size exceeds the width of the respective carton panel, it is preferred that the carton panel width be slightly greater than the width of the pour-spout panel 51. When so configured, the erected carton positions the side panels 52 and 54 in close proximity to the respective carton side panels and serves to facilitate the subsequent carton-filling operation. The double scoring used in the pour-spout 50 provides a weak memory to the scored region. As such, the pour-spout 50 tends to remain in the pouring configuration following the closing of the pour spout 50. This memory facilitates the reopening of the carton pour spout.

As seen in FIG. 5, if a liner 39 is used in conjunction with a relatively small size pour-spout 50, the minor dimensions are adjusted so as to not restrict the operation of the pour-spout 50.

As seen in FIG. 2, the pour spout region of the carton is initially sealed, with no portion of the spout 50 being visible or present along the exterior carton surface. As a result, the spout area does not detract or interfere with packaging graphics. In the initial sealed configuration, the carton contents are not able to sift through the partial cuts, perforations, or scores which define outer carton panel flap 40. Likewise, the carton contents are protected from outside contamination.

Once the carton is opened, pour spout central panel 51 and the portion of panel 40 directly opposite pour-spout panel 51 remain adhered to each other. An embossed hinge region 49 of panel flap 40 is provided to facilitate repetitive opening and closing of the pour-spout 50.

In reference to the illustrated embodiment, the partial cuts illustrated by cut lines 42 and 44 extend beyond the width of the underlying panel 51. As a result, when the pour-spout 50 is engaged, an outermost layer 41 of the exterior carton surface disengages from an inner layer of the carton along cuts 42 and 44. As a result, the side margins of panel flap 40, which terminate along lines 42 and 44, overlap with an underlying strip of the carton.

Figure 3:
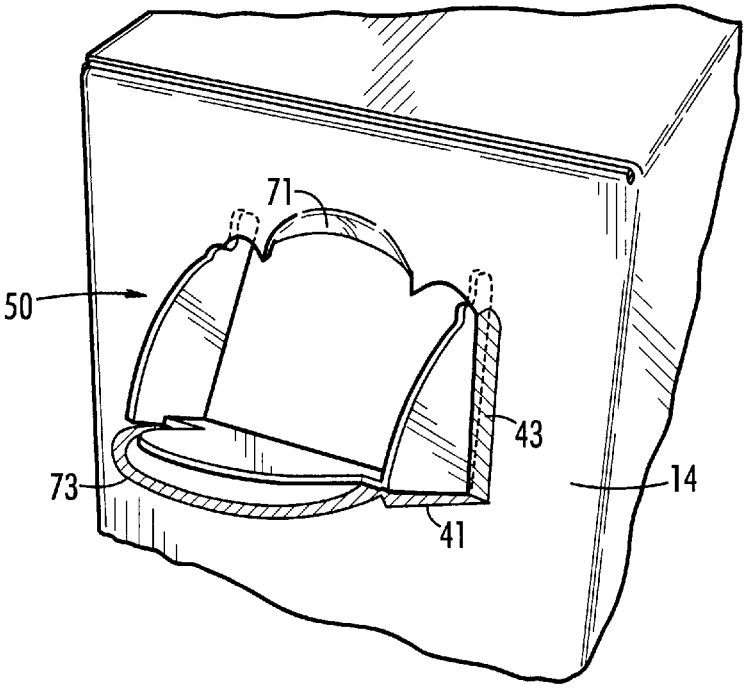
FIG. 3 is an enlarged perspective view of panel of the carton illustrated in FIG. 1, illustrating the pour spout in open position after the pour spout has been pulled away from the wall of the carton.

As seen in FIGS. 2–3, margin layer 41 is seen along one side of the pour-spout panel 51 and opposite the complimentary carton section 43. The interaction of layer 41 and carton section 43 provides a mechanical stop when the pour-spout 50 is closed. A similar overlap is provided along cut line 48. In this instance, the interior cut along line 48 provides an overlapping arcuate strip 71 of exterior carton material. The opposing carton surface 73 remains attached to the pour-spout structure upon the initial withdrawal of the pour-spout 50.

The overlapping layers which result from the initial engagement of the pour spout 50 provide a rigid set of stops for closing, and keeping closed, the pour-spout 50 and flap combination. The overlapping margins further provide an improved barrier against contamination and product loss as opposed to a flap perimeter comprising simple cuts straight through the carton walls.

As many variations of the present invention will be apparent upon a review of the detailed description, such variations are within the scope of the invention as set forth in the claims below.

That which is claimed:

1. A container having a reclosable pour spout, comprising:

a carton having an interior, an exterior, and defining at least one panel, said panel further defining a flap having an outer perimeter partially defined by one or more partial cuts within said panel;

a pour spout having a central panel, said central panel secured to an inner surface of said flap, said pour spout further comprising a first side panel and a second side panel, said first and said second side panel attached to opposite sides of the central panel along a hinge line, said first and second side panel each having a terminal projection, a shoulder and a notch therebetween;

wherein, said carton has an initial sealed configuration with said pour spout positioned entirely within the interior of said carton, said pour spout being accessible by engaging said flap and thereby positioning said pour-spout into a pouring configuration.

2. The container according to claim 1 wherein said pour-spout is plastic.

3. The container according to claim 1 wherein said pour-spout is paperboard.

4. The container according to claim 1 wherein said outer perimeter is defined by at least one partial cut along an exterior of the carton.

5. The container according to claim 1 wherein said outer perimeter is defined by at least one partial cut along an interior of the carton.

6. The container according to claim 1 wherein said flap perimeter is defined by at least one partial cut along an interior of said carton and at least one partial cut along an exterior of the carton.

7. The container according to claim 1 wherein a portion of said flap perimeter is defined by a tear strip.

8. The container according to claim 1 wherein said flap perimeter is defined by a plurality of perforations within said carton panel.

9. The container according to claim 1 wherein said flap defines a hinged base.

10. The container according to claim 9 wherein said hinged base further defines an embossed region along an attached base of said flap.

11. The container according to claim 1 wherein said flap defines an outer edge which overlaps with an outer edge of a flap aperture.

12. A carton comprising:

a first sidewall panel, said sidewall panel having an initial sealed configuration;

a pour-spout having a central panel, a first side panel, and a second side panel, said first and said second side panels connected to a respective side of said central panel by respective hinge regions of said pour-spout, said first and second side panels each having a terminal projection, a shoulder and a notch therebetween;

a flap defined by a plurality of cuts through said first sidewall panel, said flap having an inner surface secured to a first side of said central panel, wherein, when said carton has an initial sealed configuration, said flap is releasable from said plurality of cuts, permitting said flap and said pour-spout to be withdrawn into a pouring position from an initial sealed configuration.

13. The carton according to claim 12 wherein said pour-spout fits within an interior of said first sidewall panel in an initial flush position.

14. The carton according claim 12 wherein said central panel of said pour-spout has a central panel width slightly less than the width of said first sidewall panel.

15. The carton according to claim 12 wherein said flap defines a hinge at an attachment terminus of said flap.

16. The carton according to claim 12 wherein said plurality of cuts further defines a perforated perimeter around a portion of said flap.

* * * * *